United States Patent [19]

Ikeda

[11] Patent Number: 4,591,346

[45] Date of Patent: May 27, 1986

[54] SELF-RIGHTING VEHICLE WITH MEANS FOR LOCKING DRIVE WHEEL

[75] Inventor: Masaki Ikeda, Tokyo, Japan

[73] Assignee: Tomy Kogyo Co., Inc., Tokyo, Japan

[21] Appl. No.: 610,022

[22] Filed: May 14, 1984

[30] Foreign Application Priority Data

Oct. 21, 1983 [JP] Japan ..... 58-162926[U]

[51] Int. Cl.[4] ..... A63H 17/00; A63H 29/24

[52] U.S. Cl. ..... 446/437; 446/461

[58] Field of Search ..... 446/441, 461, 437, 457, 446/462, 464

[56] References Cited

U.S. PATENT DOCUMENTS

| | | | |
|---|---|---|---|
| 675,718 | 6/1901 | Converse | 446/461 |
| 682,454 | 9/1901 | Converse | 446/461 |
| 701,155 | 5/1902 | Converse | 446/461 |
| 728,286 | 5/1903 | Parker | 446/461 |
| 1,529,832 | 3/1925 | Dengler | 446/461 |
| 2,182,529 | 12/1939 | Wyrick | 446/461 |
| 2,182,642 | 12/1939 | Rexford | 446/437 X |
| 2,189,759 | 2/1940 | Lohr et al. | 446/290 |
| 3,938,278 | 2/1976 | Nakamori | 446/461 |
| 4,077,156 | 3/1978 | Asano | 446/464 |
| 4,363,187 | 12/1982 | Shinohara | 446/437 |

FOREIGN PATENT DOCUMENTS

| | | | |
|---|---|---|---|
| 287398 | 3/1926 | United Kingdom | 446/461 |

*Primary Examiner*—F. Barry Shay

*Attorney, Agent, or Firm*—K. H. Boswell

[57] ABSTRACT

A toy vehicle having a chassis and a plurality of wheels mounted on the chassis includes a wind up motor which is connected to at least one of the wheels. At least one detent is located in association with the wheel which is connected to the wind up motor. A member is mounted on the vehicle which is capable of engaging with the detent whenever the wheels of the vehicle no longer contact a support surface. Contact of the member in the detent prevents unwinding of the motor. Thus, whenever the wheels of the vehicle are not supported on the contact surface such as when the vehicle is overturned or the like the motor is prevented from unwinding.

3 Claims, 7 Drawing Figures

SELF-RIGHTING VEHICLE WITH MEANS FOR LOCKING DRIVE WHEEL

BACKGROUND OF THE INVENTION

This invention is directed to a wheeled vehicle having a wind up motor therein which is connected to at least one of the wheels so as to drive the vehicle and further including means within the vehicle for inhibiting unwinding of the wind up motor if the vehicle is inverted or otherwise reoriented from a normal position wherein it is supported by the wheels.

Over the years, a variety of toy vehicles have been developed which include small spring motors located within the vehicle. At first these spring motors were energized by utilizing a key or knob to wind up or tense the springs. Later, vehicles were developed which allowed for winding or tensing of the springs therein by rolling of the vehicle across a support surface.

The types of vehicles which can be wound by rolling the vehicle across the support surface include those which have certain clutch mechanisms allowing for rolling of the vehicle in either a forward direction to wind or tense the spring, or in the reverse direction to tense or wind the spring. In any event, irrespective of how the spring is initially tensed or wound, when released, the spring then unwinds and drives the vehicle across the support surface. Some of these vehicles include an governor or limiter which controls the rate of unwinding of the spring and thus the speed of the vehicles. In other vehicles, the mass of the vehicle coupled with the friction of the wheels of the vehicle against the support surface serves this function.

In all of the above described vehicles, however, if the vehicle is overturned, the spring continues to be discharged or unwound. In vehicles which do not include an independent governor to control the unwinding or discharging of the spring, if the vehicle is overturned, the spring is very rapidly discharged and in order for the child to once again play with the vehicle, the spring must once again be rewound.

BRIEF DESCRIPTION OF THE INVENTION

In view of the above, it is a broad object of this invention to provide a toy wheeled vehicle which is capable of moving both in a first mode wherein it moves forward by rolling on its wheels and in a second mode wherein it can do stunts and the like. It is a further object of this invention to provide a vehicle which, while doing stunts and the like, will not prematurely discharge the energy stored in a spring motor incorporated in the wheeled vehicle. It is an additional object of this invention to provide a wheeled vehicle which is capable of exhibiting a self-propelled forward motion, do a roll, flip or the like, be reoriented on its wheels and then continue forward motion. Further, it is an object of this invention to provide a vehicle which, because of its engineering principles incorporated therein is capable of a long and useful lifetime yet is economical to the consumer.

These and other objects, as will become evident from the remainder of this specification, are achieved in a toy which comprises: a vehicle chassis; a plurality of wheels rotatably mounted on said chassis in positions such that a portion of each of said wheels extends below said vehicle chassis to support said chassis above a surface with said chassis rolling on said wheels over said surface, at least one of said wheels comprising a driving wheels; a wind up motor located on said chassis, said motor operatively connected to said drive wheel to rotate said drive wheel; engageable means operatively associated with one of said motor and said drive wheel, said engageable means for preventing unwinding of said wind-up motor if said engageable means is engaged; engaging means movably mounted on said chassis in operative association with said engageable means and movable on said chassis between and engaging position with said engageable means and a nonengaging position with said engageable means, said engaging means in said engaging position interacting with said engageable means to prevent unwinding of said motor and in said non-engaging position allowing said motor to unwind and rotate said driving wheel; positioning means associated with said engaging means for positioning said engaging means in said non-engaging position when said vehicle is supported in an upright position on said surface by said wheels and for positioning said engaging means in said engaging position when said vehicle is not supported in an upright position on said surface by said wheels.

Further, these objects are achieved in a toy vehicle which comprises: a vehicle chassis; at least one wheel rotatably connected to said chassis by an axle; a motor located on said chassis and operatively connected to said wheel so as to rotate said wheel and propel said toy across a support surface; a detent means located on one of said wheel and said axle so as to rotate in conjunction with said wheel; a member pivotably mounted to said chassis so as to move between a first and second position, a first portion of said member operatively associated with said detent means and a second portion of said member extending out of said chassis in a position to contact said support surface when said wheel is in contact with said support surface, whenever said wheel does not contact said support surface, said member biased to said first position wherein said first portion of said member engages said detent means to prevent said motor from rotating said wheel, said second portion of said member contacting said surface whenever said wheel contacts said support surface moving said member to said second position allowing said motor to rotate said wheel.

In both of the above noted vehicles of the previous two paragraphs, the vehicles can be augmented by including a vehicle body which has certain members located thereon which are sized and shaped so as to allow the vehicle body to go from an inverted or upset position back to an upright position wherein the vehicle is supported by its wheels and is capable of further rolling on the wheels.

BRIEF DESCRIPTION OF THE DRAWINGS

This invention will be better understood when taken in conjunction with the drawings wherein.

This invention utilizes certain principles and/or concepts as are set forth in the claims appended to this specification. Those skilled in the toy arts will realize that these principles and/or concepts are capable of being utilized with a variety of embodiments which may differ from the embodiment utilized for illustrative purposes herein. For this reason, the invention is not to be construed as being limited only to the illustrative embodiment but is only to be construed in view of the claims.

DETAILED DESCRIPTION OF THE INVENTION

Figure 1:
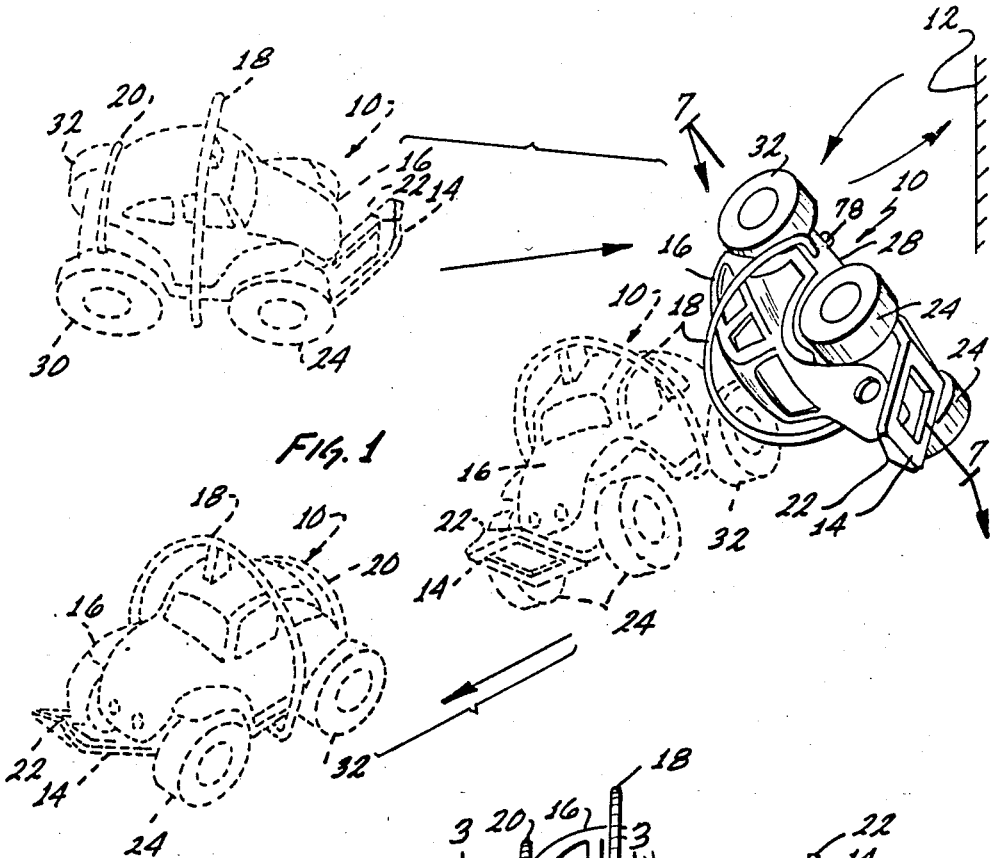
FIG. 1 is a sequential figure showing the toy vehicle of the invention exhibiting certain actions wherein the vehicle is first seen in a rolling mode and after striking an abuttment is flipped, then regains its position on its wheels so as to continue in the rolling mode.
Figure 2:
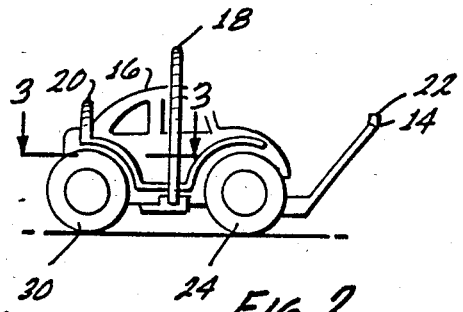
FIG. 2 is a side elevational view of the toy vehicle of FIG. 1.

FIG. 1 shows the operation of a toy vehicle 10 of this invention. In the upper left hand portion of the Figure, a first phantom figure shows the vehicle as it is moving across a support surface under the power of an internal motor as hereinafter described. In moving from the left to the right, the vehicle then strikes an abuttment 12 such as a wall or the like, and in doing so, because of the shape of its front bumper 14, it is flipped or inverted. In the right hand portion of the figure, the figure in solid line shows the toy 10 as it is rolling across certain of its upper surface features such that in the next phantom figure in the center of the figure, the vehicle has once again been rendered upright and it then continues under its own power to a further position as shown in the lower left hand corner of FIG. 1.

An important aspect of this invention is the operation of the vehicle when it is inverted and is no longer supported on the support surface by the wheels. The vehicle 10 is a wind up vehicle which is energized by rolling the vehicle 10 backwards across a support surface. This winds a spring within a spring motor as hereinafter explained, and when the vehicle 10 is then released, it is propelled forward by the tension created in winding up the spring within the motor. When the vehicle is inverted after striking the abuttment 12, unwinding or winding down of the spring within the motor ceases until such time as the vehicle is once again upright and is supported on the support surface on its wheels. At this time rotation of the driving wheels by the motor is once again resumed such that the vehicle can proceed under its own power across a support surface.

As can be seen in the figures, the upper portion of the body of the vehicle is generally rounded in shape because of the shape of certain structural members. A body member 16 is rounded both in front view and in side view. Arcing over the top of the body member 16 is a roll bar 18 which contributes to the generally rounded appearance of the toy. A back lip 20 is also rounded such that if the toy is inverted and comes to rest on either the roll bar 18 or the back lip 20 or both, it will roll along these surfaces to right itself such that it is once again resting on its wheels. The bumper 14 is shaped to include a point 22 in its center which, in combination with the roll bar 18 will cause the toy 10 to roll to one side or the other.

The bumper 14 additionally has a forward pitch such that upon striking of an abuttment such as abuttment 12, the front of the toy 10 rides up the abuttment along the pitch of the bumper 14 until the toy 10 is out of balance, at which time it then flips, such as to the position shown in solid line in FIG. 1, to initiate the rolling action. The internal components of the toy 10 are generally all located in a manner within the interior of the toy 10 to place the center of gravity below the center of rotation of the toy 10. Because of this, when inverted the toy 10 will upright itself and land back on its wheels.

The toy 10 includes a front set of wheels collectively identified by the numeral 24 which are mounted about an axle 26. The axle 26 is mounted in appropriate bearing cutouts formed in a chassis member 28 with the result being that the front wheels 24 are free wheeling.

A pair of rear wheels 30 and 32 are fixed to a rear axle 34 with the totality of the rear wheels 30 and 32 and the axle 34 rotating together. A detent member 36 is mounted on the inboard side of rear wheel 30, with a similar detent member 38 mounted on the inboard side of rear wheel 32. In the illustrative embodiment of the toy 10 the detent members 36 and 38 are formed as a portion of the rear wheels 30 and 32. However, this is not mandatory. The detents could be separated parts fixed to the axle 34 or other drive train members between it and the motor as identified below. The rear axle 34 is appropriately held in bearing surfaces formed in the chassis member 28 which are not numbered or shown in the drawings.

Figure 4:
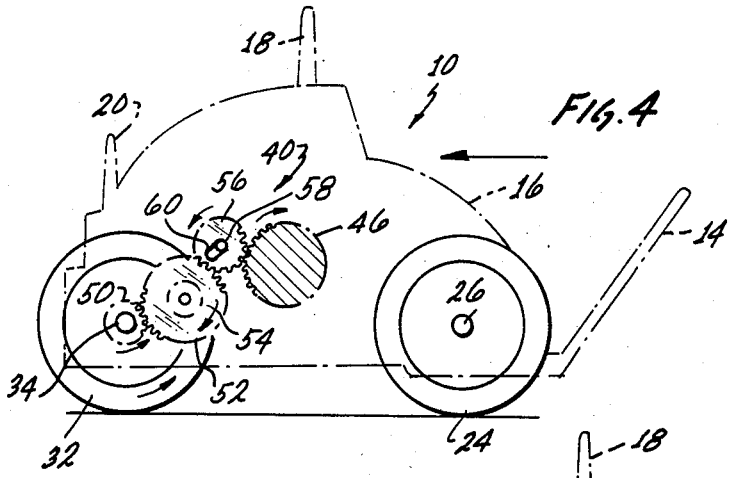
FIG. 4 is a view similar to FIG. 2 except certain overlying components are not shown so as to better illustrate internal components.

The toy 10 utilizes a small spring motor generally depicted by the numeral 40 to propel it across a support surface. The motor is such that when the rear wheels 30 and 32 are rotated backwards, i.e., counterclockwise as seen in FIG. 4, a helical spring 42 is tightened, or coiled around a motor shaft 44 to induce a bias in it.

Fixed to the motor shaft 44 is a large pinion 46 as well as a spur gear 48. In FIG. 4, the coiling or tensing of the spring 42 is shown. A pinion 50 is fixed to the rear axle 34. The pinion 50 meshes with a spur gear 52 which is appropriately suspended by an axle 54 in appropriate bearing surfaces not shown formed in the chassis 28. A swing gear 56 is mounted about an axle 58 which rides within slots collectively identified by the numeral 60 formed in the chassis member 28. When the swing gear 56 descends downwardly in slot 60 as seen in FIG. 4, it engages with the spur gear 52 and the pinion 46 mounted on the motor shaft 44. Backward movement of the toy 10 as seen in FIG. 4 transfers motion from the rear wheels 30 and 32 via the rear axle 34 to the pinion 50. The pinion 50 in turn rotates the spur gear 52 which in turn rotates the swing gear 56 which in turn rotates the pinion 46 which in turn coils up the spring 42. This energizes the spring 42 to energize the motor 40, such that upon release of the toy 10, uncoiling of the spring 42 via a different gear train will drive the toy 10 forward. The swing gear 56 is engaged with the spur gear 52 during counterclockwise rotation of the axle 34 as seen in FIG. 4. On clockwise rotation of the axle 34 the counterclockwise motion transferred to the spur gear 52 causes the swing gear 56 to ride up within the slot 60 disengaging the gear train between the spur gear 52 and the pinion 46.

Figure 3:
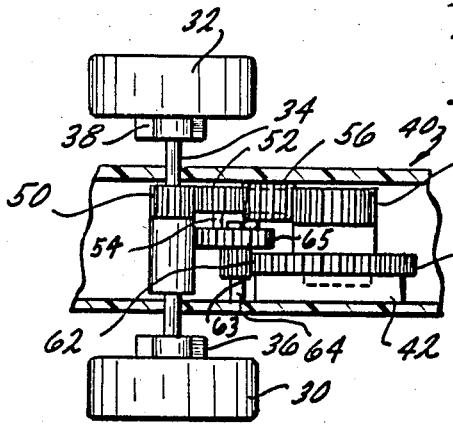
FIG. 3 is a fragmentary plan view in partial section about the lines 3—3 of FIG. 2.
Figure 5:
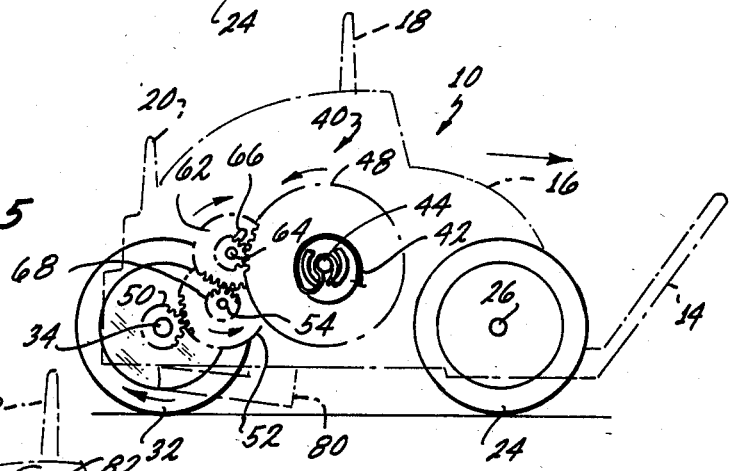
FIG. 5 is a view similar to FIG. 4 except certain other internal components are illustrated therein.

The gear train to drive the toy 10 forward differs from that previously described and utilized to wind the spring 42. The spur gear 48 which is also fixed to the motor shaft 44 engages a pinion formed as a portion of a second swing gear 62. This is seen in FIG. 5. As shown in FIG. 3, swing gear 62 is a composite gear including a pinion portion 63 and a spur gear portion 65. The swing gear 62 is mounted about an axle 64 which rides in slots 66 formed in the chassis member 28. Counterclockwise rotation of the spur gear 48 under the influence of unwinding of the spring 42 drives the swing gear 62 downward in the slots 66 so as to engage spur gear portion 65 of swing gear 62 with a pinion 68 which is formed in conjunction with spur gear 52 about axle 54. Rotation of the pinion 68 by the swing gear 62 is transferred via the spur gear 52 to the pinion 50 to rotate the axle 34 and the wheels 30 and 32 attached thereto to propel the toy 10 forward.

As is evident from the above, one or the other of the swing gears 56 or 62 engage with the combination of gears 52 or 68. During winding of the spring 42 motion is transferred via spur gear 52 to swing gear 62 and during unwinding of the spring 34 motion is transferred via swing gear 62 through pinion 68.

The toy 10 is also capable of free wheeling. If the toy 10 is either given a push by the operator of the same, or is given forward momentum via unwinding of the spring 42, once the force giving the toy 10 the forward momentum is removed, the toy 10 will continue to coast under this momentum. During this coasting, the rear wheels 30 and 32 are rotating clockwise, which in turn rotates the pinion 50 clockwise. This rotates the spur gear 52 and the pinion 68 counterclockwise. Counterclockwise movement of these gears shift the swing gear 56 upwardly out of engagement with the pinion 46 and lifts the swing gear 62 upward out of engagement with pinion 68.

Figure 6:
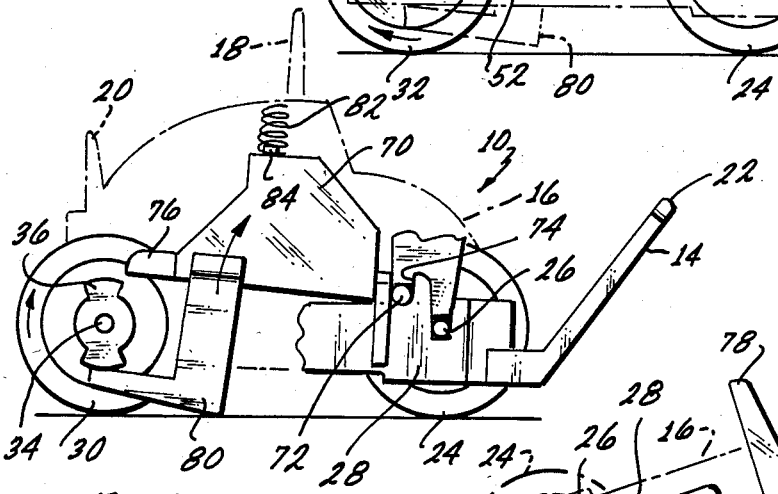
FIG. 6 is a view similar to FIGS. 4 and 5 showing other internal components of the toy vehicle.
Figure 7:
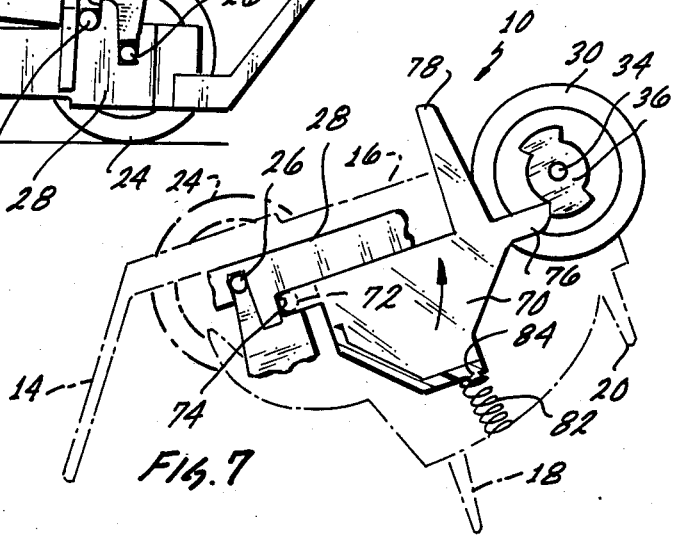
FIG. 7 is a side elevation view in partial section showing the interaction of certain components of the vehicle when the vehicle is in an inverted position.

An engaging member 70 is pivoted about axles 72 in bearing slots 74 formed in the chassis member 28. This allows the engagement member 70 to pivot about the axles 72. On the back edge of the engagement member 70 is an engaging tooth 76 which is positioned such that it can lock against the detent member 38 formed on the inside of rear wheel 32. This is best seen in FIG. 7. When toy 10 is in an upright position as is shown in FIG. 6, the engagement member 70 (not seen in FIG. 6) would be in a non-engaging position with engagement tooth 76 raised upward out of the pathway of the detent member 38. In FIG. 7, the engagement member 70 is in an engaging positon with the detent member 38. This locks the rear wheel 32, the rear axle 34 and the motor 40 fixed against rotation in a direction which would unwind the spring 42. In FIG. 6, portions of the vehicle which would be in the foreground have been removed, namely rear wheel 30, detent member 36 mounted thereon and some chassis components. As such, in FIG. 6, inside rear wheel 32 and detent member 38 are shown. In the side elevational view of FIG. 6, detent member 36 on rear wheel 30 would exactly overlay detent member 38 as is clear from FIG. 3. This positions detent member 36 in close proximity to a limiting arm 80 also formed on member 70.

Projecting downwardly and formed as a part of the engagement member 70 is a surface contact arm 78. When the toy 10 is upright and is supported on a support surface by its wheels 24, 30 and 32, the surface contact arm 78 engages the surface on which the toy is supported such that it is pushed upwardly causing the engagement member 70 to pivot to the non-engaging position. If the rear wheels 30 and 32 are lifted upwardly from the support surface, the end of the surface contact arm 78 no longer engages the support surface allowing the engagement member 70 to pivot about its axles 74 to the engaging position wherein the engaging tooth 76 locks with the detent member 36.

As noted above, also formed as a portion of the engagement member 70 is limiting arm 80. The limiting arm 80 projects downwardly and underneath the detent member 38 formed on the rear wheel 30. The presence of the limiting arm 80 only allows the engagement member 70 to rotate a few degrees clockwise as seen in FIG. 6 when it moves from the engaging to the non-engaging position under the influence of the surface contact arm 78 abutting against the support surface. This maintains position of the engaging tooth 76 in close proximity to the detent member 38 such that as soon as the surface contact arm 78 no longer contacts a support surface, the engagement member 70 can immediately rotate from the non-engaging to the engaging position to lock the rear wheels 30 and 32, the rear axle 34 and the motor against rotation of the rear wheels 30 and 32 in a clockwise manner.

The limiting arm 80 serves another function. The engagement member 70 is biased downwardly by gravity such that the surface contact arm 78 is normally biased downwardly toward a support surface. When the toy 10 is upset and starts to roll, gravity initially biases the engagement member downwardly while the toy is still in an upright position. As the toy 10 starts to roll, the direction of the force of gravity on the engagement member 70 changes until, when the toy is completely upside down, gravity, of course, would tend to rotate the engagement member 70 from the engaging to the non-engaging position. However, prior to this happening, if the engaging tooth 76 has not yet interacted with the detent member 38 to lock the two together, a lobe on the detent member 36, as it spins, engages the limiting arm 80, and forces the limiting arm 80 in a direction away from the axle 34 which brings the engaging tooth 76 into the pathway of the lobes of the detent member 38 such that tooth 76 and detent 38 lock together as seen in FIG. 7, to hold the engaging member 70 in the engaging position, stopping unwinding of the spring 42.

In an alternate embodiment the limiting arm 80 could be removed and a small spring noted by the numeral 82 in FIG. 6, could be placed around a peg 84 formed on top of the engagement member 70. The spring 82 would extend between the top of the engagement member 70 and the inside surface of the body member 16 such that whenever the engagement member 70 is in the non-engaging position the spring 82 is compressed and as soon as the rear wheels 30 and 32 are lifted above the support surface allowing the surface contact arm 80 to move downwardly, the spring 82 would bias the engagement member 70 to the engaging position.

In any event, once the engagement member 70 is engaged with the detent member 36, all unwinding of the spring 42 stops, and until such time as the toy 10 is righted such that once again the surface contact arm 78 contacts the support surface and the engagement member 70 is moved from the engaging position to the non-engaging position, the force which is stored in the spring 42 will be maintained. As soon as the vehicle 10 is once again resting on the rear wheels 30 and 32, the surface contact arm 78 makes contact with the surface freeing the engagement member 70 from the detent member 76 to once again allow the motor 40 to rotate the rear wheels 30 and 32 to propel the toy vehicle 10 across the support surface.

I claim:

1. A toy vehicle which comprises:

a vehicle chassis;

a front axle having a pair of front wheels mounted thereon, said front axle being rotatably mounted on said chassis;

a rear axle having a pair of rear wheels located thereon, said rear axle being rotatably mounted on said chassis, at least one of said rear wheels comprising a driving wheel;

at least a portion of each of said wheels extending below said vehicle chassis to support said chassis above a surface with said chassis rolling on said wheels over said surface;

a windup motor mounted on said chassis, said motor being operatively connected to said drive wheel to rotate said drive wheel;

a detent member operatively associated with said drive wheel, said detent member being fixed to said drive wheel for rotation therewith;

an engaging member having an axle, said engaging member being pivotally mounted on said chassis about its axle so as to pivot on said chassis;

said engaging member including an engaging tooth and a surface contact arm, said engaging tooth being located in operative association with said detent member in a position above said rear axle, said surface contact arm located so as to extend downward from said chassis toward said surface;

a vehicle body attached to said vehicle chassis, said vehicle including a front bumper, said front bumper extending upwardly and outwardly of said body at an angle to said vehicle chassis and being shaped to form means whereby as said vehicle rolls on said wheels over said support surface if said front bumper strikes a relatively vertically extending surface of an abutment in the path of said vehicle as said vehicle rolls, said bumper interacts with said surface so as to lift the front of said vehicle upwardly to flip said vehicle;

said vehicle body further including at least one surface means located thereon, said surface means including a peripheral surface shaped so as to allow said toy to roll about said peripheral surface whereby if said toy is inverted on a supporting surface, said toy rolls about said peripheral surface from an inverted position to an upright position;

said engaging tooth on said engaging member locking with said detent member on said drive wheel so as to lock said drive wheel when said vehicle is in said inverted position.

2. The toy vehicle of claim 1 wherein:

said surface contact arm on said engaging member and said engaging tooth on said engaging member are positioned with respect to one another such that when said vehicle is in an upright position said surface contact arm extends below said vehicle to contact said support surface and in response to contact of said support surface said surface contact arm pivoting said engaging member and moving said engaging tooth in a direction away from said detent member.

3. The toy vehicle of claim 1 wherein:

said engaging member further includes a limiting arm, said limiting arm mounted on said engaging member so as to be positioned below said rear axle;

said limiting arm mounted postitioned in association with said detent member whereby when said vehicle is in an inverted position said limiting arm contacts said detent member to limit the pivoting of said engagement member on said chassis to maintain said engagement tooth in proximity with said detent member.

* * * * *